US006663430B2

(12) United States Patent
Usui et al.

(10) Patent No.: US 6,663,430 B2
(45) Date of Patent: Dec. 16, 2003

(54) CONNECTOR, CONNECTOR CONNECTION STRUCTURE AND ELECTRONIC EQUIPMENT

(75) Inventors: Hideyuki Usui, Chigasaki (JP); Hirohide Komiyama, Zama (JP); Masayoshi Nakano, Machida (JP)

(73) Assignee: International Business Machines Corporation, Armonk, NY (US)

( * ) Notice: Subject to any disclaimer, the term of this patent is extended or adjusted under 35 U.S.C. 154(b) by 61 days.

(21) Appl. No.: 09/832,573

(22) Filed: Apr. 11, 2001

(65) Prior Publication Data

US 2001/0031578 A1 Oct. 18, 2001

(30) Foreign Application Priority Data

Apr. 14, 2000 (JP) ..... 2000-114328

(51) Int. Cl.[7] ..... H01R 13/648

(52) U.S. Cl. ..... 439/609; 439/607; 439/108; 439/939

(58) Field of Search ..... 439/609, 607, 439/108, 939

(56) References Cited

U.S. PATENT DOCUMENTS

| | | | | | |
|---|---|---|---|---|---|
| 4,934,960 | A | * | 6/1990 | Capp et al. | 439/939 |
| 5,752,854 | A | * | 5/1998 | Capp et al. | 439/939 |
| 6,015,304 | A | * | 1/2000 | Yagi et al. | 439/607 |
| 6,042,398 | A | * | 3/2000 | Wu et al. | 439/607 |

* cited by examiner

*Primary Examiner*—Tho D. Ta
(74) *Attorney, Agent, or Firm*—J. Bruce Schelkopf

(57) ABSTRACT

A connector for achieving stabilization of operation of electronic equipment against EMI/ESD by reinforcing grounding of an entire connector is provided for. An interface connector has protruding portions formed on a top face and bottom face of a metal shell, wherein the height of these protruding portions is in a predetermined relationship to one another, such that the connector and connector connection structure provide: a reduction in the contact resistance in fitting portions of connectors, and hence an improvement in conductivity.

10 Claims, 7 Drawing Sheets

( Prior Art )

( Prior Art )

( Prior Art )

( Prior Art )

CONNECTOR, CONNECTOR CONNECTION STRUCTURE AND ELECTRONIC EQUIPMENT

FIELD OF THE INVENTION

The present invention relates to connectors and connector connection structures that are applied to electronic equipment, and in particular, to a connector which is electrically connected to another connector in a manner where a connector having a convex metal shell section is fitted into a connector having a concave metal shell section, a connector connection structure, and electronic equipment provided with the connector or connector connection structure.

DESCRIPTION OF THE RELATED ART

In general, regarding electronic equipment, in a connector for connection to external equipment, reinforcing countermeasures relating to grounding are taken against EMI (Electro Magnetic Interference) and ESD (Electro Static Discharge).

In an example of a notebook type personal computer (hereinafter, notebook PC) 120 and a docking station 130 shown in FIG. 4, a multipole type interface connector for electrically connecting those pieces of equipment with each other for communication is devised for the reinforcement of the grounding.

As shown in FIGS. 5 and 6, a conventional interface connector 100 that is provided on the docking station 130 comprises a synthetic resin connector body 102 where a convex metal shell 104 is mounted, a signal terminal section 106 with 240 pins, and a power supply and ground terminal section 108 with 4 pins.

In addition, guide posts 109 protrude from both end sections of the connector body 102 for positioning the connector at the time when the connector connection is established, and an end of each guide post 109 is made to be a tapered shape.

When this interface connector 100 is installed in the docking station 130, a terminal section 104E of the metal shell 104 that protrudes from a back face of the connector is made to be grounded (earth) through a chassis and the like.

Furthermore, on this metal shell 104, five protruding portions 110 which are arranged in almost equal intervals along the width direction of the connector are formed on each of a top face 104A and a bottom face 104B of the outer surface that becomes a fitting section, and one protruding portion 110 is provided also on each of a right-hand side face 104C and a left-hand side face 104D. All of these protruding portions 110 have the same shape and the same height.

Owing to this, when an interface connector 122 in the notebook PC 120 is connected to the interface connector 100, the metal shell sections of both connectors fits together, and the protruding portions 110 strongly contact to the inner surface of the concave metal shell section of the connector in the notebook PC. Hence, contact resistance is reduced, and hence conductivity (electric conductivity) is improved and grounding is reinforced. In this manner, a malfunction of equipment caused by EMI/ESD is prevented from occurring.

However, in the interface connector 100 described above, as shown in FIG. 7, when the interface connector 122 of the notebook PC is connected thereto, the metal shell 124 of the interface connector 122 is deformed so that the vicinity of a central portion thereof swells out in its width direction (directions shown by an arrow A and an arrow B) by being pressed by the protruding portions 110 arranged near the ends of a top face 104A and a bottom face 104B of the metal shell 104. In the figure, a state of the central portion of the metal shell 124 swelling out is schematically shown by a chain double-dashed line.

Owing to this, there are problems occurring, between the protruding portions 110 arranged in the vicinity of the central portion of the metal shell 104 and the metal shell 124, such as contact pressure (surface pressure) decreases, conductivity deteriorates, and hence a grounding effect in that part worsens.

In present notebook PCs and docking stations, high-level operation guarantees against EMI/ESD are demanded. Since, contact pressure varies in these structures among the protruding portions and the grounding effect often becomes partially weakened as a result, electromagnetic noise is easily superimposed on a signal line, and trouble caused by electro-static discharge readily occurs.

SUMMARY OF THE INVENTION

In consideration of the above-described facts, an object of the present invention is to provide a connector, in which conductivity is improved by reducing contact resistance in a connector fitting section, having a connector connection structure, and electronic equipment to which the connector or connector connection structure is applied.

According to one embodiment, the invention is directed to a connector having a convex metal shell section, comprising a plurality of protruding portions provided on a outer surface of the convex metal shell section where a concave metal shell section fits, wherein, protruding portions provided toward a central portion of the outer surface are made higher than protruding portions provided toward edge sides of the outer surface Furthermore, another object of the present invention is to provide a connector, in which stabilization of operation of the electronic equipment against EMI/(ESD is planned by reinforcing grounding of the entire connector, a connector connection structure, and electronic equipment to which the connector or connector connection structure is applied.

DETAILED DESCRIPTION OF THE INVENTION

Figure 1:
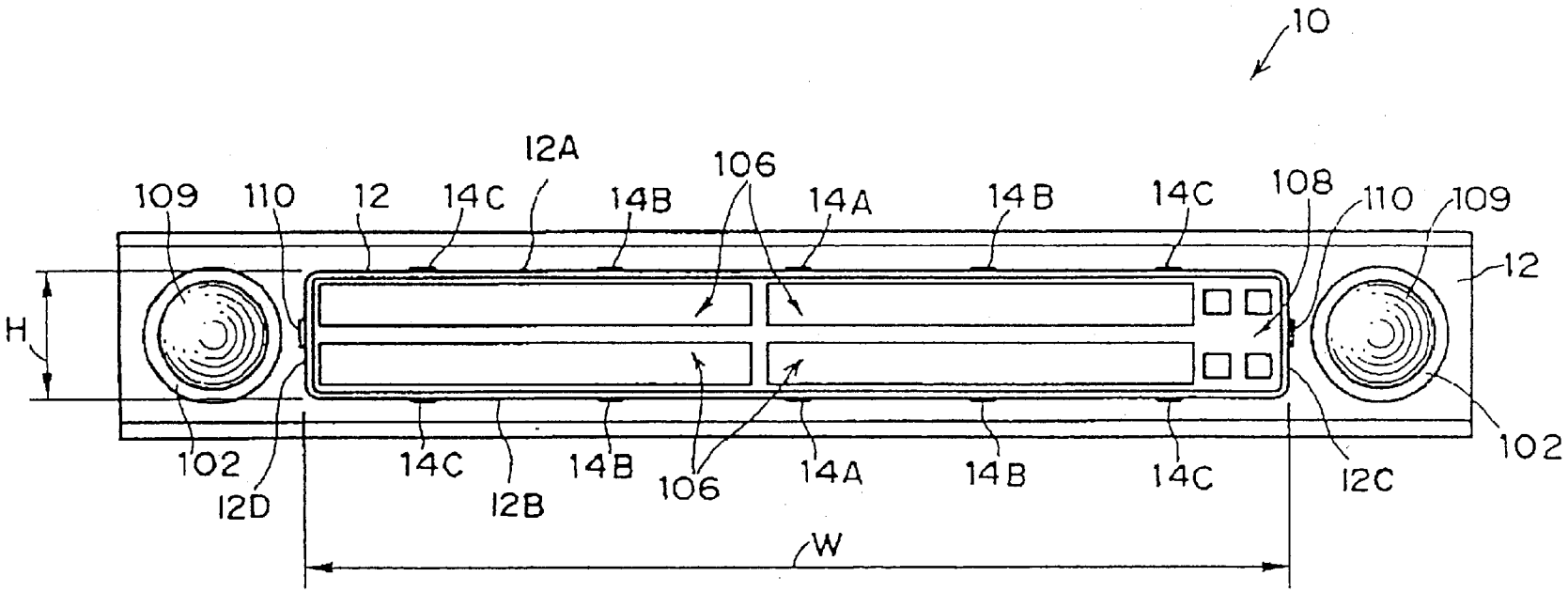
FIG. 1 is shows an interface connector according to an embodiment of the present invention.

In order to achieve above-described objects, one embodiment of the present invention provides for a connector having a convex metal shell section, comprising a plurality of protruding portions provided on a outer surface of the convex metal shell section where a concave metal shell section fits, in which, regarding the plurality of protruding portions, protruding portions provided toward a central portion of the outer surface are made higher than protruding portions provided toward edge sides of the outer surface.

In the above-described embodiment, regarding the plurality of protruding portions provided on the outer surfaces of the convex metal shell section included in the connector, the protruding portions provided toward the central portion of the outer surface are made higher than the protruding portions provided toward edge sides of the outer surface. Hence, it is possible to keep high contact pressure since the protruding portions, provided toward the central portion, are in contact even if a central portion of a inner surface is deformed to "swell out" as a result of being pressed by the protruding portions of the edge sides through the concave metal shell section fitting.

Owing to this, for the plurality of protruding portions, contact resistance between each of them and the concave metal shell section is lessened, and hence conductivity is improved.

In another embodiment, a plurality of protruding portions may further be provided on the inner surface of the metal shell section in the connector having the concave metal shell section. In this embodiment, since protruding portions provided toward a central portion of the inner surface are made higher than protruding portions provided toward edges side of the inner surface, it is possible to obtain a similar effect as that previously described in the first-described embodiment.

In another aspect of the present invention, a connector connection structure is provided, where the structure comprises: a first connector having a convex metal shell section; and a second connector having a concave metal shell section, in which a plurality of protruding portions is provided on a outer surface of the convex metal shell section where the concave metal shell section fits, and regarding the plurality of protruding portions, protruding portions provided toward a central portion of the outer surface are made higher than protruding portions provided toward edge sides of the outer surface.

In the above-described connector connection structure, with regard to the plurality of protruding portions provided on the outer surfaces of the convex metal shell section included in the first connector, the protruding portions that are toward a central portion of the outer surface are made higher than protruding portions provided toward edge sides of the outer surface. Hence, it is possible to keep high contact pressure since the protruding portions provided toward the central portion are in contact even if a central portion of a inner surface is deformed to "swell out" by being pressed by the protruding portions of the edge sides through the concave metal shell section fitting included in the second connector.

In this aspect, it is also possible to provide the plurality of protruding portions on the inner surface of the metal shell in the second connector having the concave metal shell section and protruding portions provided toward a central portion of the inner surface are made higher than protruding portion provided in edge sides of the inner surface. Hence it is possible to obtain the same effect as that in the above-described structure.

In addition, still another aspect of the present invention is a connector connection structure comprising: a first connector having a convex metal shell section; and a second connector having a concave metal shell section, in which at least one of the convex metal shell section and the concave metal shell section is grounded, and electronic equipment is grounded by the convex metal shell section being fitted in the concave metal shell section when the first connector and the second connector are connected electrically, a plurality of protruding portions is provided on a lateral surface of the convex metal shell section where the concave metal shell section fits, and regarding the plurality of protruding portions, protruding portions provided toward a central portion of the outer surface are made higher than protruding portions provided toward edge sides of the outer surface.

In the above-described connector connection structure, regarding the plurality of protruding portions provided on the outer surfaces of the convex metal shell section included in the first connector, protruding portions provided toward a central portion of the outer surface are made higher than protruding portions provided toward edge sides of the outer surface. Hence, conductivity between them and the concave metal shell section of the second connector fitted over the convex metal shell section is improved.

Owing to this, since grounding is performed between all the plurality of protruding portions and the concave metal shell section, it can be performed to uniformly ground the edge sides and central portion of the metal shell section. Therefore, grounding is reinforced in the entire connector.

The plurality of protruding portions may be provided on the concave metal shell section provided in the second connector. In that aspect also, by making protruding portions provided toward a central portion of the inner surface higher than protruding portions provided toward edge sides of the inner surface, it is possible to obtain the same effect as that in the above-described structure.

In addition, in the above-described connector connection structure, each of the plurality of protruding portions can be arranged in a symmetric position about a central line in the fitting direction of the outer surface of the convex metal shell section, and each protruding portion which is arranged in the symmetric position can be made to be the same height.

Owing to this, almost equal grounding can be performed in both sides of the outer surface that sandwich the central line.

In addition, here, the plurality of protruding portions provided in the inner surface of the concave metal shell section can be arranged in symmetric positions about a central line in the fitting direction of the outer surface. Hence, in that aspect also, it is possible to obtain the same effect as that in the above-described structure.

Furthermore, in the above-described connector connection structure, the number of the plurality of protruding portions provided can be of three or more, whereby protruding portions provided in an almost central portion of the outer surface of the convex metal shell section can be made to be the highest. Such a structure is preferable in a case of a connector having a large width due to a large number of pins.

In addition, this structure can be also applied to the plurality of protruding portions provided on the inner surface of the concave metal shell section.

In addition, a further aspect of the present invention is a connector connection structure, in which a side cross-sectional shape of each of the protruding portions is made to be a shape of continuing to the metal shell section and being curved along the fitting direction of the metal shell section. Such a structure reduces a load by a catch with the protruding portions when the metal shell section fits, that is, when the connectors are connected with each other. Hence it becomes possible to perform smooth connector connection.

In addition, a still further aspect of the present invention is electronic equipment that comprises the above-described connector or connector connection structure.

Figure 2:
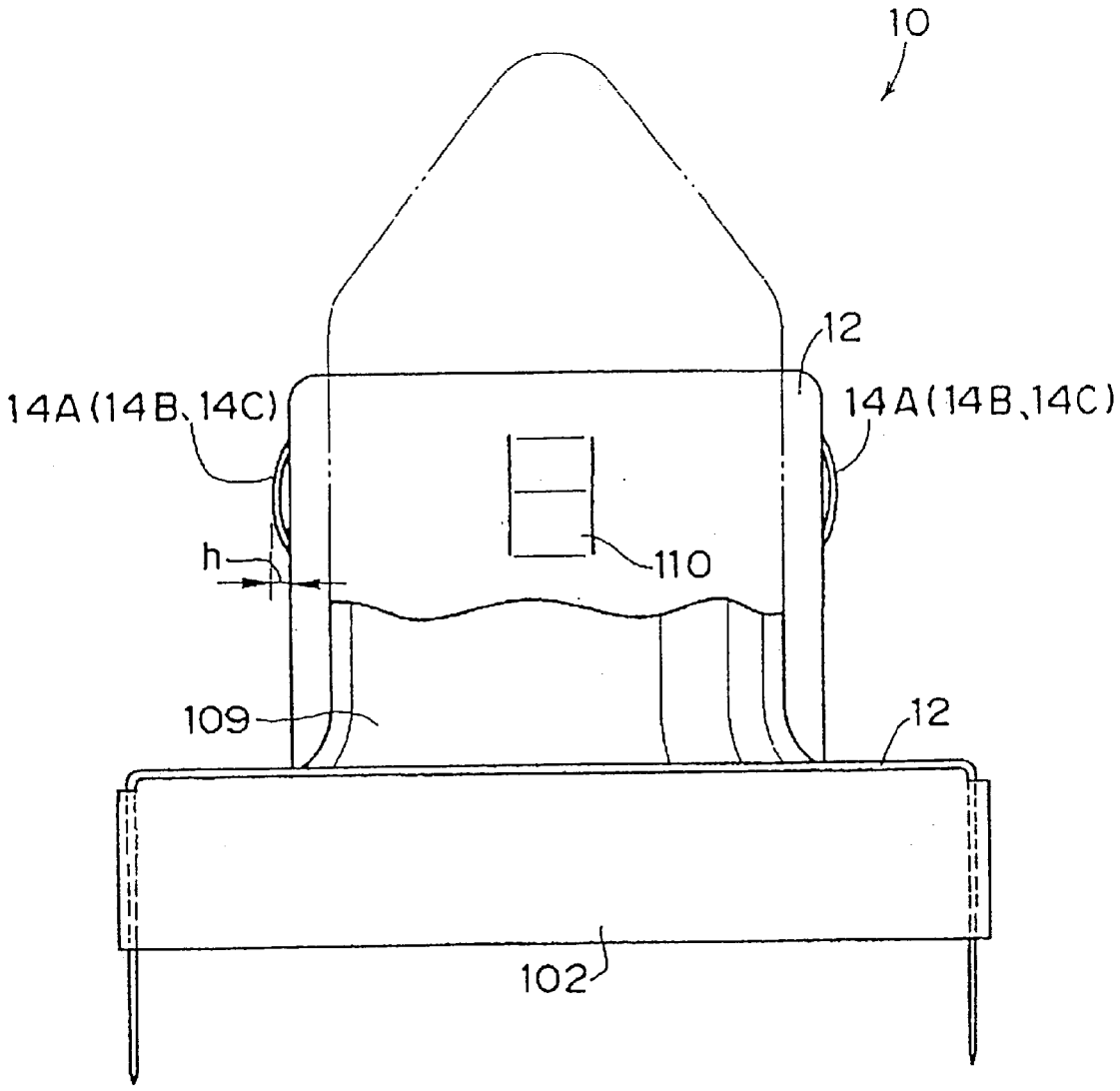
FIG. 2 is an enlarged side view of the interface connector shown in FIG. 1.

Hereinafter, an embodiment of the present invention will be described with reference to drawings. FIGS. 1 and 2 show an interface connector 10 according to an embodiment of the present invention.

This interface connector 10 is used for connection of a notebook PC and a docking station that are newly developed, and is provided in the docking station. Nevertheless, since the structure of the entire connector, pin count, and arrangement are the same as those of a conventional interface connector, the same numerals can be assigned and their description will be omitted.

As shown in FIGS. 1 and 2, also in a outer surface of a metal shell 12 mounted in the interface connector 10, a total of 12 protruding portions are located.

In a top face 12A and a bottom face 12B of the metal shell 12, protruding portions are arranged in vertical symmetry, protruding portions 14A each are arranged in the center in a width direction of each of both sides, and protruding portions 14B are arranged in equal intervals in both adjacent sides of the protruding portions 14A. Furthermore, protruding portions 14C are also arranged in equal intervals in the outside of the protruding portions 14B (the edge sides of the metal shell 12), Then, relationship of height of these protruding portions is made to be: protruding portions 14A >protruding portions 14B>protruding portions 14C.

In addition, as shown in FIG. 2, regarding side cross-sectional shapes of the protruding portions 14A, 14B, and 14C, each base end part of the protruding portions continues with a surface of the metal shell 12, and each protruding part of the protruding portions is curved in an almost circular arc shape along a fitting direction (connector insertion direction) of the metal shell.

Furthermore, in each central portion of a right side face 12C and a left side face 12D of the metal shell 12, the protruding portions 110 that are the same as conventional ones are formed.

Each side cross-sectional shape of these protruding portions 110 is also curved in a shape that is the same as one of the protruding portions 14A, 14B, and 14C.

Moreover, each of the above-described protruding portions can be easily produced on the shell surface by forming in another process after deep drawing of an external shape of the metal shell 12 with dies, and dimensions of each portion are as follows.

Contour dimensions of a fitting portion of the metal shell are 7.5 mm in height and 57.7 mm in width. Contour dimensions of each protruding section are 1.5 mm in width, and the protruding sections are arranged at 11 mm pitches with each of the protruding portions 14A as a center. Their protruding amounts (h) from a surface of the metal shell are 0.22 mm for the protruding portions 14A, 0.19 mm for the protruding portions 14B, and 0.10 mm for the protruding portions 14C.

Figure 3:
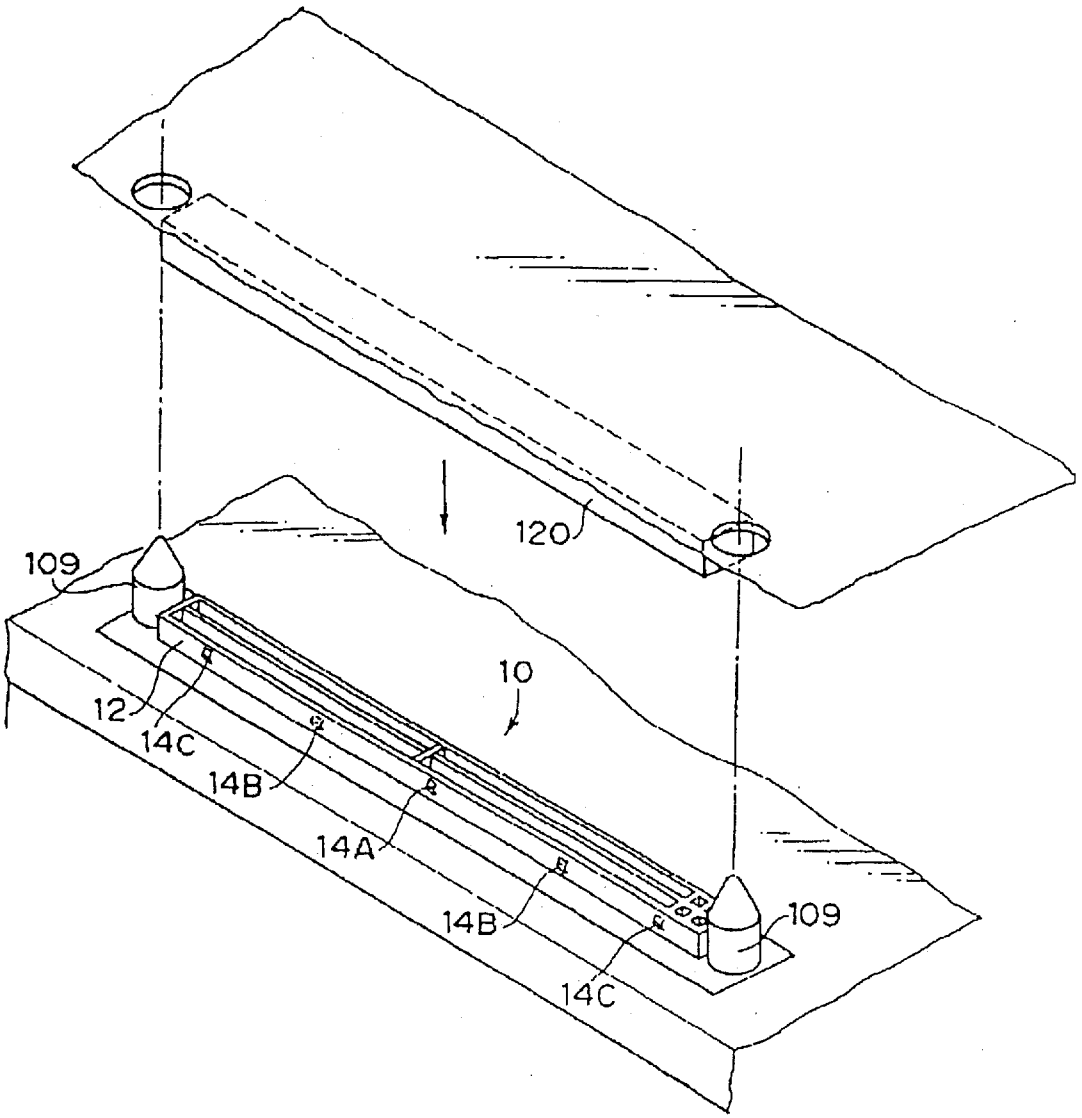
FIG. 3 is a schematic perspective view showing a state of connecting a mating interface connector to an interface connector according to an embodiment of the present invention.
Figure 4:
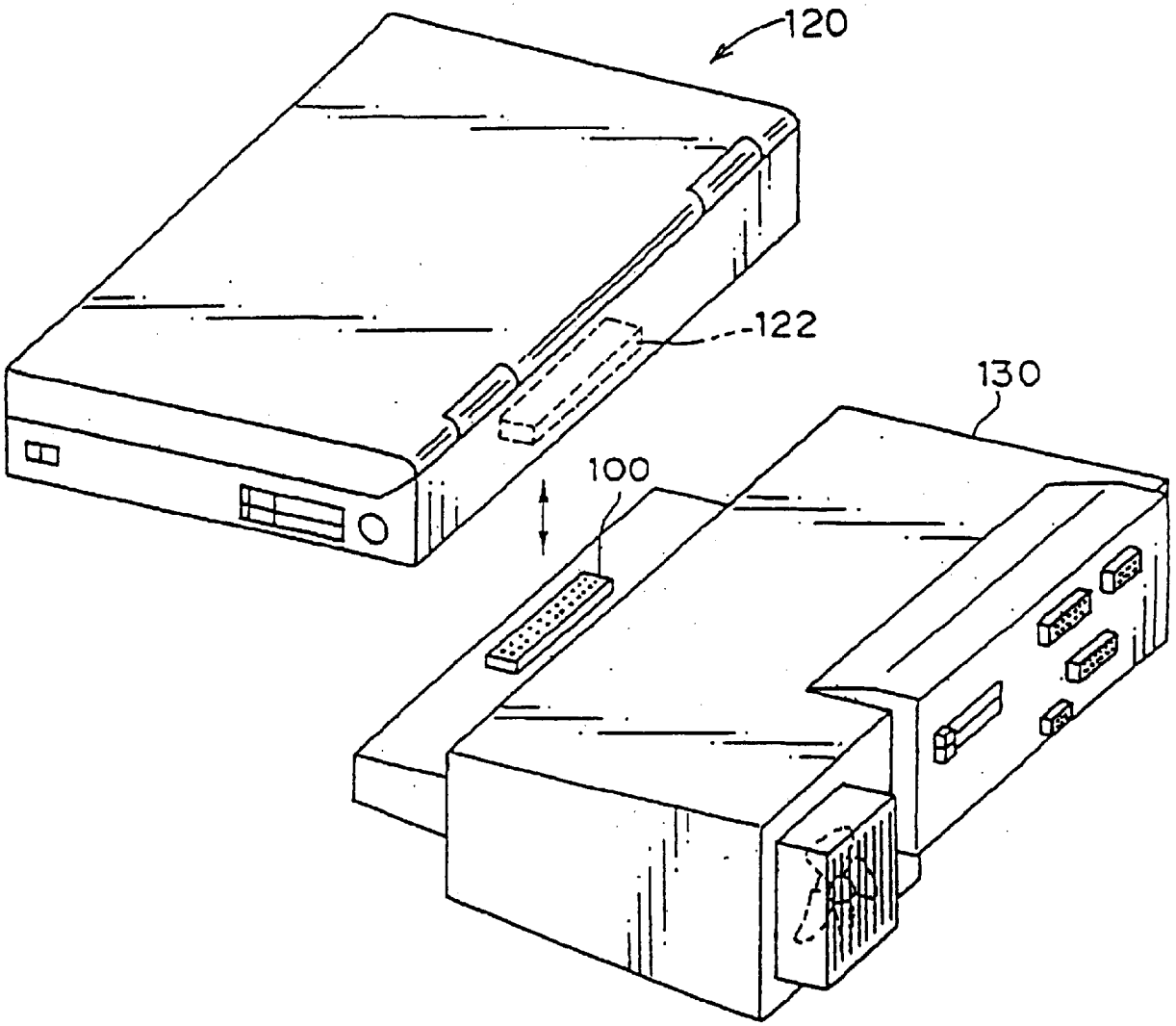
FIG. 4 is a perspective view showing a state of connecting a notebook PC and a docking station that use conventional interface connectors.
Figure 5:
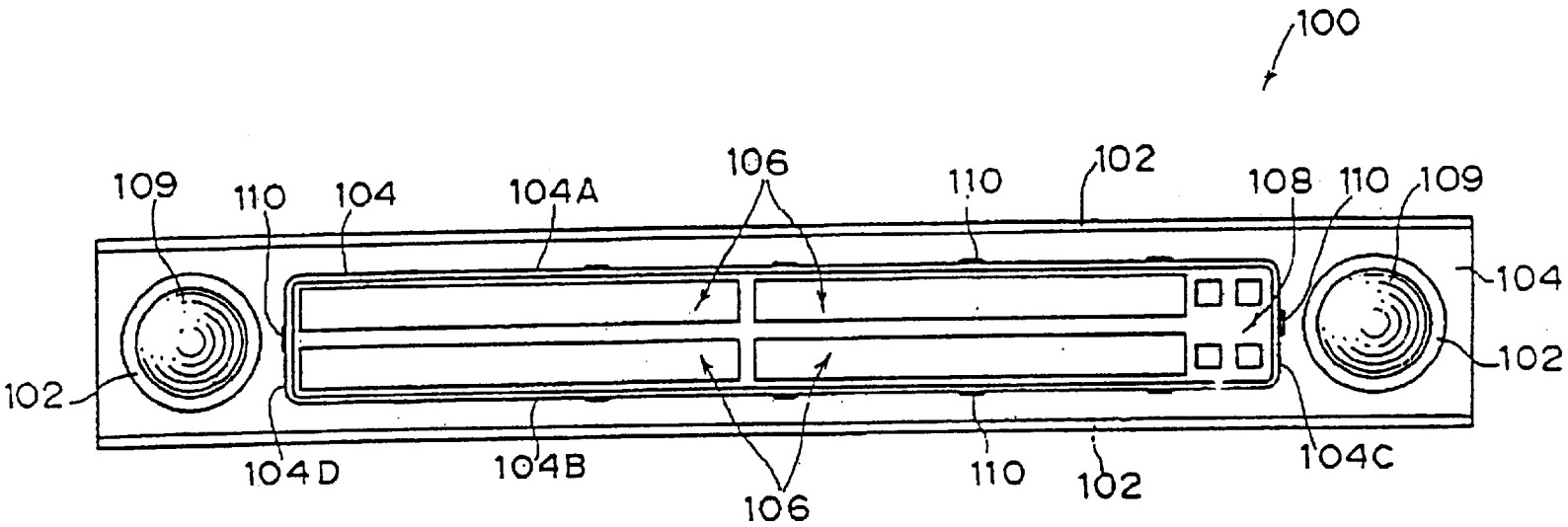
FIG. 5 is a plan showing a conventional interface connector.
Figure 6:
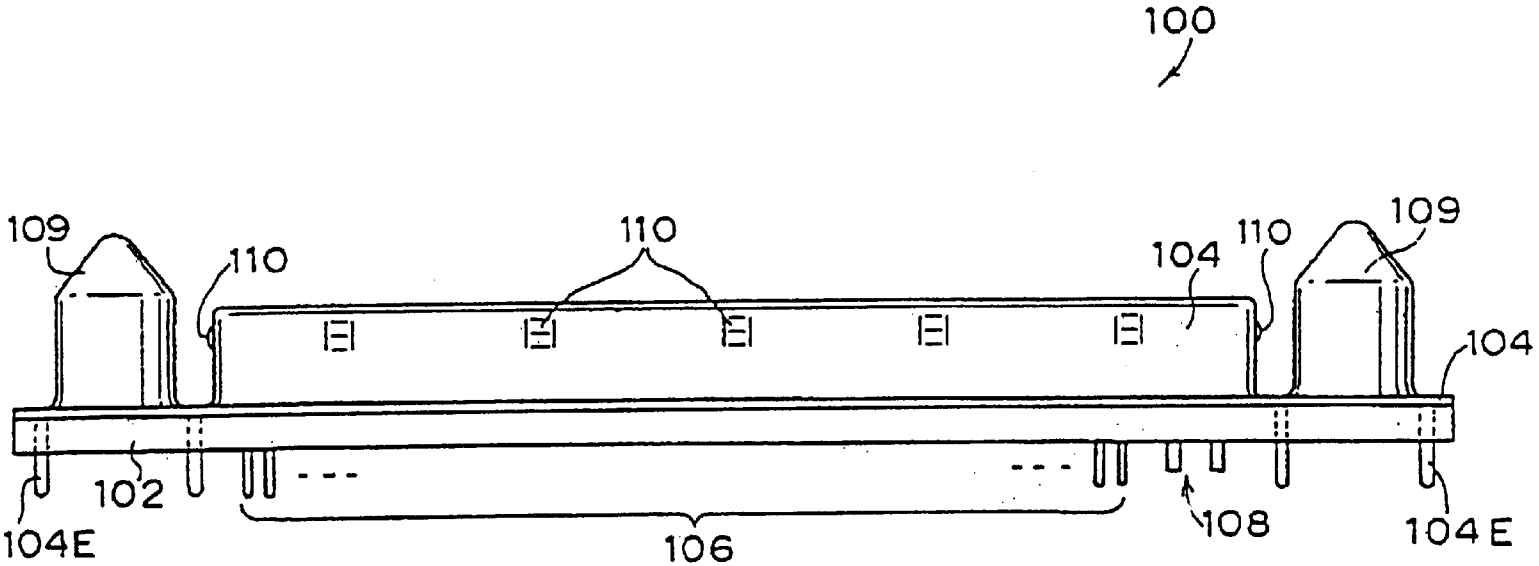
FIG. 6 is a front view of the interface connector shown in FIG. 5.
Figure 7:
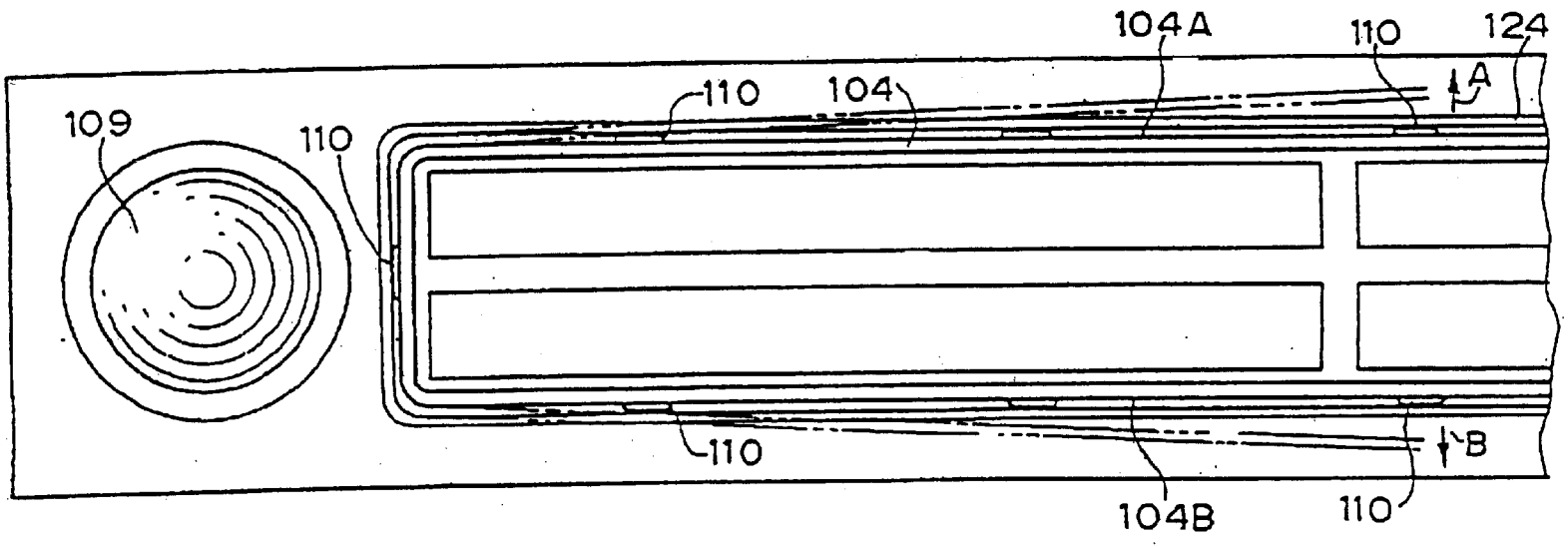
FIG. 7 is an enlarged view of an almost left half of the interface connector shown in FIG. 5, and is also an explanatory diagram showing such a state that a metal shell of a mating interface connector that fits is deformed.

FIG. 3 shows a state of connecting an interface connector 122 of a notebook PC to the interface connector 10 according to the present embodiment. In this manner, communication between both equipment becomes possible through the interface connectors by docking the notebook PC with the docking station.

Here, when both connectors are connected with each other, and both metal shells fit together, a metal shell of the interface connector 122 is pressed by the protruding portions 14C located in edge sides of the metal shell 12, and in consequence, a central portion of a inner surface of the metal shell swells out.

Nevertheless, the protruding portions 14B arranged inside are higher than the protruding portions 14C, and furthermore each of the protruding portions 14A that is central is made to be the highest. Hence, the difference of contact pressure among the protruding portions 14A, 14B, and 14C becomes small, and each contacts with the metal shell of the interface connector 122 in high contact pressure.

Owing to this, edge sides and a central portion of each metal shell are uniformly grounded, and hence, grounding is reinforced in the entire interface connectors 10 and 122. Besides, in the top face 12A and bottom face 12B of the metal shell 12, layout and height of the protruding portions are made to be symmetrical about the central line in the fitting direction of the metal shell. Hence, it is possible to achieve almost equal grounding in the whole area of the top face 12A and bottom face 12B.

On the other hand, in the connective operation of the connectors, each side cross-sectional shape of the protruding portions 14A, 14B, 14C, and 110 is a shape of continuously protruding from the surface of the metal shell 12 and being curved along the fitting direction. Hence, the load caused by a catch of each protruding portion is reduced, and hence smooth fitting (connector connection) becomes possible. In addition, also when connector connected is pulled out, it is possible to pull the connector out by a desired pulling-out force.

The connector and connector connection structure of the present invention provide: a reduction in the contact resistance in fitting portions of connectors, and hence an improvement in conductivity. In addition, besides, grounding is reinforced in the entire connectors, and hence stabilization of the operation against EMI/(ESD is achieved in the electronic equipment to which the connector connection structure is applied.

Furthermore, shapes, individual and/or total counts, intervals, and the like of the protruding portions are not limited to any one of the embodiments herein, but can be appropriately changed or modified depending on conditions based on connector sizes and shapes.

Moreover, although the present invention may be preferably applied to the connector having the convex metal shell section, such application is not so limited herein, as it is possible to apply the present invention to the concave metal shell section mounted in the mating connector, as well as to other embodiments and variations of the present invention.

Furthermore, in addition to grounding reinforcement, it is possible to use the present invention for improving conductivity in other ways in other applications.

Moreover, it is conceivable to those skilled in the art a connector and connector connection structure according to the present invention can be applied in a variety of applications in other electronic equipment beyond that of connector connection for a notebook PC and/or a docking station.

It will be further understood that various changes in the details, materials, and arrangements of the parts which have been described and illustrated in order to explain the nature of this invention may be made by those skilled in the art without departing from the principle and scope of the invention as expressed in the following claims.

What is claimed is:

1. A connector for providing electrical connectivity to a mating connector, the connector comprising:

a metal shell configured to mate to a mating connector;

a plurality of protruding portions protruding outward from the surface of the metal shell, the plurality of protruding portions configured to provide high contact pressure with the mating connector, wherein selected protruding portions protrude outward to a greater extent than other protruding portions.

2. The connector of claim 1, wherein the extent of the protruding portions is greatest for protrusions closest to a connector axis, the connector axis being substantially parallel to an insertion direction.

3. The connector of claim 1, wherein the extent of the protruding portions is symmetric about a connector axis, the connector axis being substantially parallel to an insertion direction.

4. The connector of claim 1, wherein the plurality of protruding portions are symmetrically positioned about a connector axis, the connector axis being substantially parallel to an insertion direction.

5. The connector of claim 1, wherein the plurality of protruding portions are positioned near an edge of the metal shell.

6. The connector of claim 1, wherein the plurality of protruding portions protrude from an inner surface of the metal shell.

7. The connector of claim 1, wherein the plurality of protruding portions protrude from an outer surface of the metal shell.

8. The connector of claim 1, wherein the metal shell is convex in shape.

9. The connector of claim 1, wherein the metal shell is concave in shape.

10. A computer for interfacing with a peripheral device via a connector, the computer comprising:

a CPU configured to execute instructions;

a memory configured to store data; and a connector for providing electrical connectivity to a mating connector, the connector comprising:

a metal shell configured to mate to a mating connector;

a plurality of protruding portions protruding outward from the surface of the metal shell, the plurality of protruding portions configured to provide high contact pressure with the mating connector, wherein selected protruding portions protrude outward to a greater extent than other protruding portions.

* * * * *